US005715690A

United States Patent [19]

Ponder

[11] Patent Number: 5,715,690

[45] Date of Patent: Feb. 10, 1998

[54] MICROWAVE THERMAL HEAT PUMP DEFROSTER

[76] Inventor: Henderson F. Ponder, P.O. Box 145, Summerville, Ga. 30747

[21] Appl. No.: 725,615

[22] Filed: Oct. 3, 1996

[51] Int. Cl.[6] ..... F25D 21/12

[52] U.S. Cl. ..... 62/82; 62/151; 62/282

[58] Field of Search ..... 62/80, 82, 150, 62/151, 153, 154, 155, 156, 272, 275, 276, 282

[56] References Cited

U.S. PATENT DOCUMENTS

| | | | |
|---|---|---|---|
| 1,821,754 | 9/1931 | Huyette . | |
| 2,110,693 | 3/1938 | Bailey . | |
| 2,195,924 | 4/1940 | Hoesel . | |
| 2,297,970 | 10/1942 | Merz . | |
| 2,401,560 | 6/1946 | Graham et al. . | |
| 2,474,304 | 6/1949 | Clancy . | |
| 2,780,442 | 2/1957 | Breeding . | |
| 2,793,834 | 5/1957 | Henney et al. . | |
| 2,806,674 | 9/1957 | Biehn . | |
| 2,919,558 | 1/1960 | Lauer . | |
| 2,970,816 | 2/1961 | McCarty . | |
| 3,006,613 | 10/1961 | Coyne . | |
| 3,103,794 | 9/1963 | Kyle et al. . | |
| 3,176,760 | 4/1965 | Murdoch . | |
| 3,189,085 | 6/1965 | Eberhart . | |
| 3,219,102 | 11/1965 | Taylor . | |
| 3,318,372 | 5/1967 | Shell . | |
| 3,444,923 | 5/1969 | Kyle et al. . | |
| 3,529,659 | 9/1970 | Trask . | |
| 3,867,979 | 2/1975 | Carrasse et al. . | |
| 4,086,779 | 5/1978 | Lewis | 62/282 |
| 4,102,389 | 7/1978 | Wills . | |
| 4,102,391 | 7/1978 | Noland et al. . | |
| 4,105,064 | 8/1978 | Del Toro et al. . | |
| 4,112,705 | 9/1978 | Sisk et al. . | |
| 4,143,707 | 3/1979 | Lewis et al. . | |
| 4,373,350 | 2/1983 | Noland . | |
| 4,404,816 | 9/1983 | Ibrahim et al. | 62/151 |

*Primary Examiner*—John M. Sollecito

[57] ABSTRACT

A microwave thermal heat pump defroster system, utilizing a magnetron tube, or other microwave energy generating device, for the application of heat to the external surfaces of the outside coil of an electric heat pump, while the heat pump is operating in the heating mode for the following purposes, (1) to defrost the outside coil of the heat pump, (2) to inhibit the accumulation of frost on the external surfaces of the outside coil of the heat pump, and (3) to allow heat so applied to the external surfaces of the outside coil of the heat pump to be absorbed into the heat pump system via the outside coil of the heat pump, in a manner that will improve the efficiency of the heat pump.

16 Claims, 2 Drawing Sheets

MICROWAVE THERMAL HEAT PUMP DEFROSTER

BACKGROUND OF THE INVENTION

This invention relates in general to air conditioning systems usually referred to as electric heat pumps, which utilize reverse cycle refrigeration apparatus to condition air inside a building for heating in the winter months, and for cooling in the summer months, and relates in particular to the application of heat to the external surfaces of the outside coil of an electric heat pump for the purpose of defrosting, and/or inhibiting the accumulation of frost on the external surfaces of the outside coil of an electric heat pump, and further relates to causing such heat to be absorbed into the heat pump system via the outside coil of an electric heat pump for maximum heat economy.

The use of heat to defrost the outside coil of an electric heat pump is old and well known. However, the typical method is to reverse the flow of refrigerant (usually Freon) inside the system so that the inside coil of the heat pump which is used as a condenser when the heat pump is operating in the heating mode, is converted to an evaporator, causing that coil to become cold, and the outside coil which is used as an evaporator when the heat pump is operating in the heating mode, is converted to a condenser, causing that coil to become hot. In reality, the heat pump is converted to an air conditioner for the duration of the defrost cycle.

Consequently, heat pumps of the prior art operate to collect heat from inside a building and to use such heat to defrost the outside coil of the heat pump, which is changed to a condenser for the duration of the defrost cycle, allowing such heat to radiate into the ambient air outside the building and to be lost. The system is thus required to operate for a considerable amount of time after returning to the heating mode, just to recover the heat lost during the defrost cycle, and as a result, the efficiency of the heat pump is diminished considerably.

In general terms, when an electric heat pump is operating in the heating mode, a liquid refrigerant such as Freon is pumped through a system of pipes, valves and coils. When it passes through the outside coil, a heat exchanger coil which is disposed outside the area to be heated, the refrigerant becomes very cold as it changes from liquid to vapor. Heat is absorbed into the system as ambient air is caused to pass over and through the external surfaces of the outside coil of the heat pump, by a fan. The refrigerant is then passed through a compressor, which increases both its pressure and temperature. From there, the heated vapor goes to the inside coil, a heat exchanger coil which is disposed inside a warm air duct, where the heat is absorbed and carried inside the area to be heated. When it passes through the inside coil the refrigerant is condensed, changing back to a liquid. It then flows through a valve and back to the outside coil to continue the cycle.

In the air conditioning mode, a reversing valve changes the direction in which the refrigerant moves through the system. This causes the inside coil to act as an evaporator and the outside coil to act as a condenser. Heat is thus absorbed from the air inside the building and discharged outside.

When the conventional heat pump requires defrosting, the flow of refrigerant is reversed and the heat pump is converted to an air conditioner for the duration of the defrost cycle. While the system is operating in the defrost mode, heat is absorbed from inside the building and discharged into the ambient air outside. Consequently, the building requiring heat, looses heat instead.

Furthermore, many heat pumps have disposed therein, usually near the inside coil, a number of electric heat elements which are used to supply additional heat when needed or desired. Switching devises are used to turn these heat elements on during the defrost cycle in an effort to restore to the building some of the heat lost when the flow of refrigerant is reversed. However, much of the heat generated by these heat elements radiates directly to the inside coil which is then the coldest object in the vicinity. This is due to the fact that heat always moves from a warm body to a cold body. Since heat radiates at a speed which is many thousand times faster than the speed of the air passing through the air duct, it should be obvious that much of the heat generated by the heat elements, especially heat that is radiated from the back side of the heat elements, will go to the inside coil of the heat pump, which is then operating as an evaporator, and be absorbed into the heat pump system and carried to the outside coil where it is wasted to the ambient air.

SUMMARY OF THE INVENTION

Accordingly, it is an object of the present invention to provide a microwave thermal heat pump defroster system, utilizing a magnetron tube, or other microwave energy generating device, referred to hereinafter as "microwave energy means", for the application of heat to the external surfaces of the outside coil of an electric heat pump, for the purpose of defrosting the outside coil of an electric heat pump.

It is another object of the present invention to provide a microwave thermal heat pump defroster system for the application of heat to the external surfaces of the outside coil of an electric heat pump, for the purpose of inhibiting the accumulation of frost on the outside coil of an electric heat pump.

It is yet another object of the present invention to provide a microwave thermal heat pump defroster system for the application of heat to the external surfaces of the outside coil of an electric heat pump, while the heat pump is operating in the heating mode.

It is still another object of the present invention to provide a microwave thermal heat pump defroster system for the application of heat to the external surfaces of the outside coil of an electric heat pump, without the need to reverse the flow of refrigerant inside the heat pump system.

Test show that when an electric heat pump is operating in the heating mode, more heat is collected from a given volume of air when the temperature of the air is high than is collected from the same volume of air at a lower temperature. Further test show that the temperature of air exiting the outside coil of an electric heat pump remains approximately the same when the temperature of the air entering the outside coil is substantially raised by heat from an external source, and at the same time, the temperature of the air exiting the inside coil is higher. This proves that additional heat applied to the external surfaces of the outside coil of an electric heat pump is absorbed, and carried through the heat pump system to the inside coil where it is discharged into the building.

Therefore, it is also an object of the present invention to provide a microwave thermal heat pump defroster system for the application of heat to the external surfaces of the outside coil of an electric heat pump, that will allow such heat to be absorbed into the outside coil of the heat pump to improve the economy thereof.

The nature and objects of the present invention will become more readily apparent from the following description of a preferred embodiment, as described below and shown in the attached drawings.

DESCRIPTION OF THE PREFERRED EMBODIMENT

Figure 1:
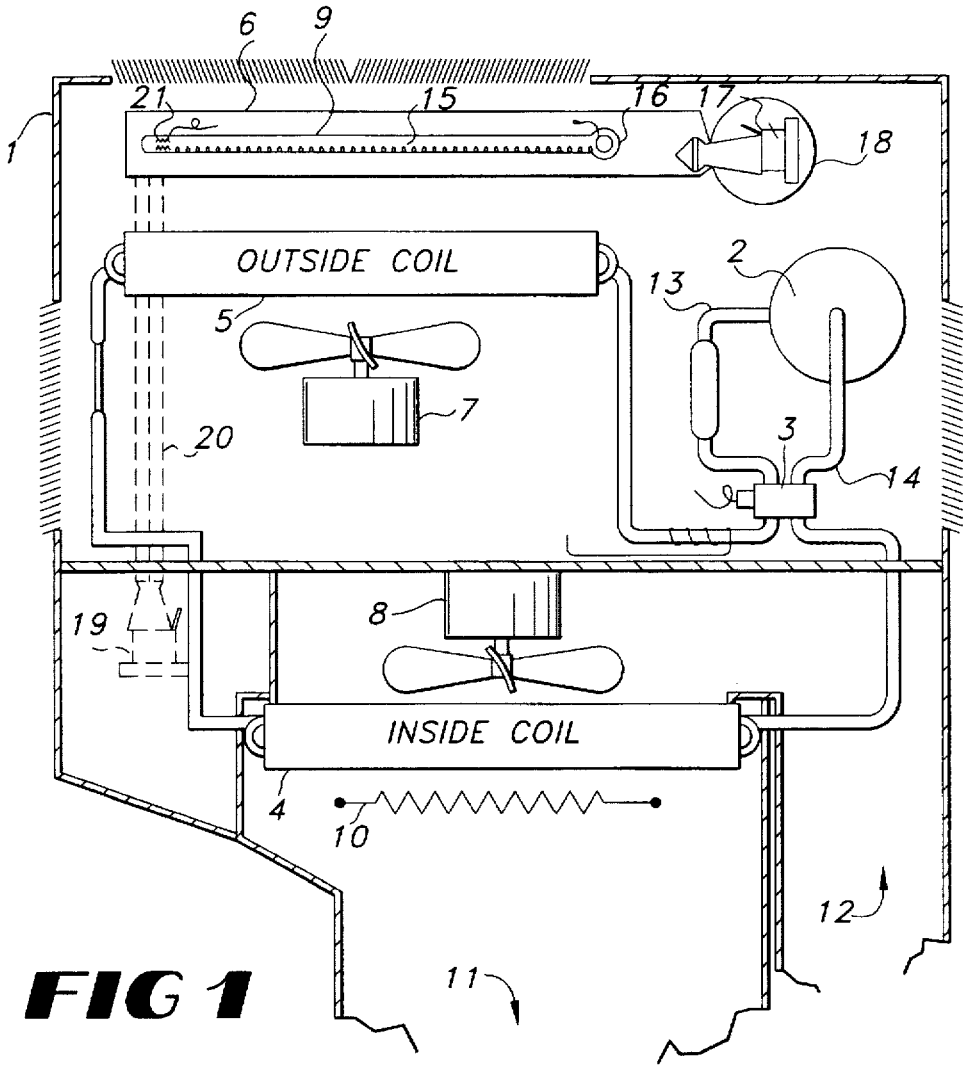
FIG. 1 shows a pictorial view of a conventional electric heat pump with added apparatus 6, 9, 15, 16, 17, 18, 19, 20, and 21 which are parts of the present invention.

Turning first to FIG. 1, there is shown generally at 1 the embodiment of an electric heat pump, at 2 a compressor, at 3 a reversing valve, at 4 an inside heat exchanger coil, at 5 an outside heat exchanger coil, at 6 a microwave energy chamber, at 7 a fan, at 8 another fan, at 9 a non-metallic liquid container, at 10 an electric heat element, at 11 a warm air duct, at 12 a return air duct, at 13 a suction line, at 14 a hot gas line, at 15 a system of vertical pipes, at 16 a float operated contact switch, at 17 a magnetron tube, or other microwave energy generating device, referred to hereinafter as microwave energy means, at 18 a protective shield, at 19 an alternate location for the microwave energy means shown at 17, at 20 a location for a wave guide for transmitting microwave energy from the alternate microwave energy means shown at 19, if used, at 21 a thermal sensing switch.

Figure 2:
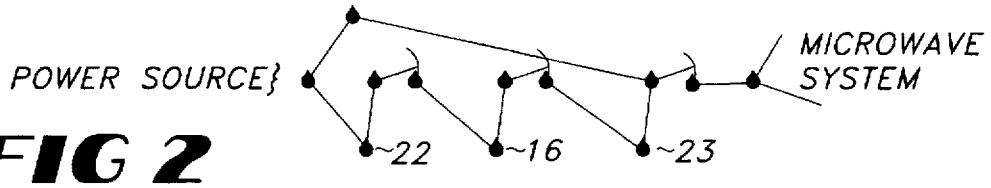
FIG. 2 shows a functional schematic diagram of a control system to operate the microwave energy means shown at 17, FIG. 1.
Figure 3:
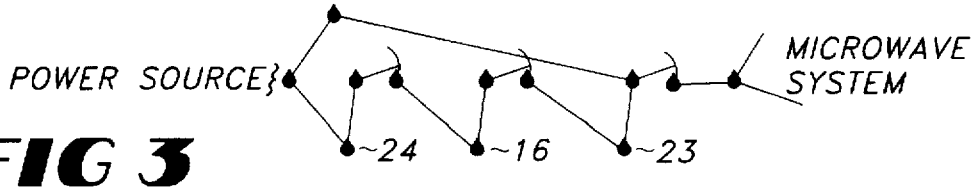
FIG. 3 shows a functional schematic diagram of a control system to operate the microwave energy means shown at 17, FIG. 1 when only the alternate version of the present invention is used.
Figure 4:
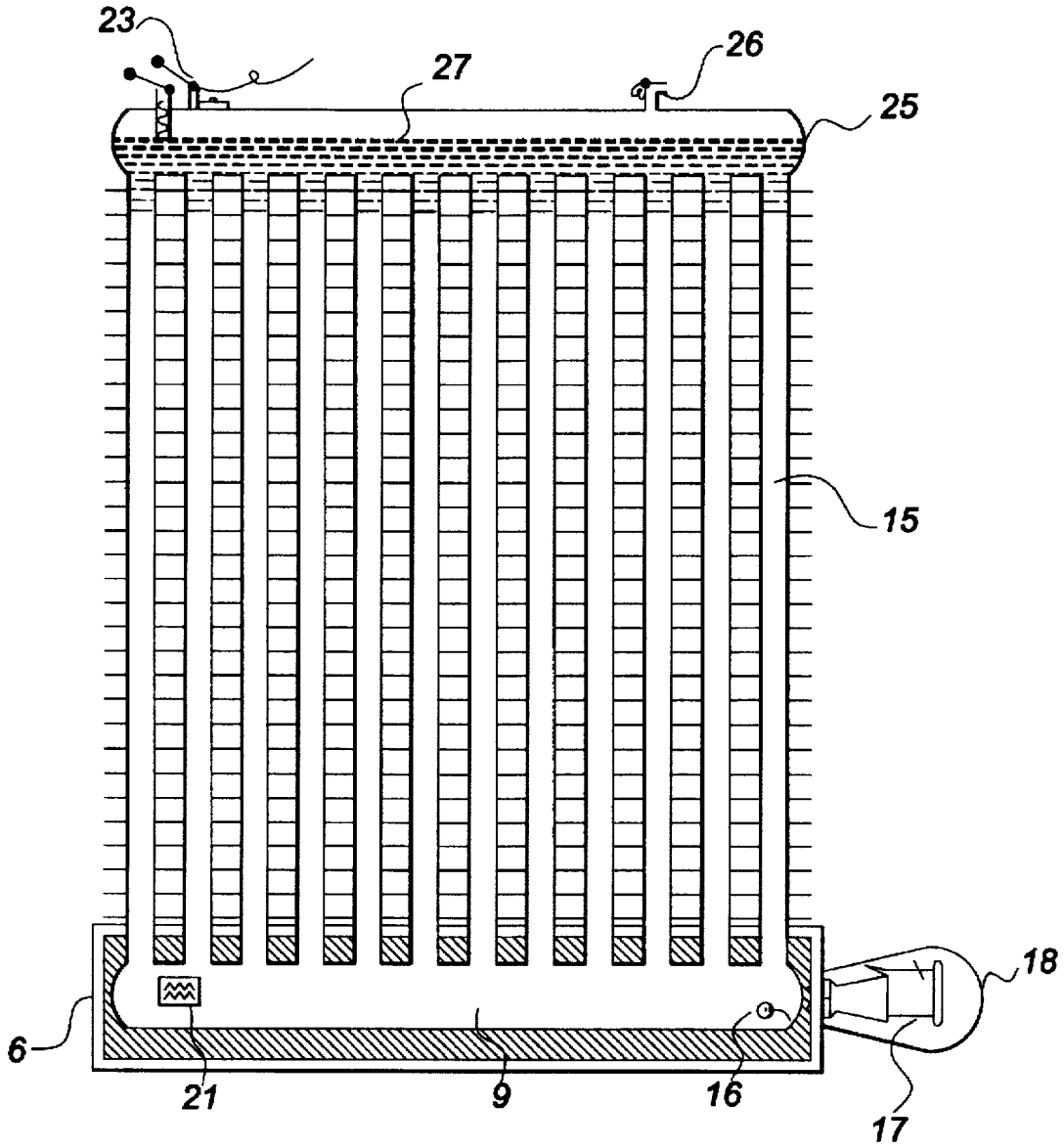
FIG. 4 shows a detailed flat vertical frontal view of the microwave thermal defroster system shown at 6, 9, 15, 16, 17, 18, and 21 FIG. 1, with added apparatus 23, 25, 26, and 27.

In addition to the regular components of an electric heat pump which are well known to all concerned, the microwave energy means shown at 17, also shown at FIG. 4, is disposed to generate microwave energy for the purpose of defrosting the outside coil of the heat pump. The microwave energy chamber shown at 6, also shown at FIG. 4, is disposed to receive microwave energy generated by the microwave energy means. The non-metallic liquid container shown at 9, also shown at FIG. 4, is disposed to contain a quantity of liquid coolant such as anti-freeze, which is heated by microwave energy generated by the microwave energy means shown at 17. The system of vertical pipes shown at 15, forms the circulating system of a radiator much like the radiator of an automobile, and is shown in more detail in the drawing at FIG. 4. The pipes are disposed to deliver heat upwards by means of convection so that heat will be absorbed into ambient air flowing over and through the external surfaces of said radiator before flowing over and through the external surfaces of the outside coil of the heat pump. The dotted lines shown at 19 indicates an alternate position for the microwave energy means at 17. The dotted lines at 20 indicates the position for a wave guide to transmit microwave energy from the microwave energy means in the event that said microwave energy means is placed in alternate position 19. The float operated contact switch at 16, also shown in the drawings at FIG. 2, FIG. 3, and FIG. 4, is designed to turn off the flow of electricity to the microwave energy means when there is insufficient liquid within the non-metallic liquid container shown at 9 to absorb the microwave energy. The protective shield shown at 18, also shown at FIG. 4, is designed to protect the microwave energy means at 17 from excessive moisture. The thermal sensing switch shown at 21, also shown at FIG. 4, is designed to set the fan motor at 7 to a slow speed when the temperature of the liquid coolant within the non-metallic liquid container reaches a predetermined high.

Turning next to FIG. 4, there is shown a detailed flat vertical frontal view of the microwave thermal defroster system shown at 6, 9, 15, 16, 17, 18, and 21 FIG. 1, with added apparatus 23 which is a pressure sensitive circuit breaker, 25 which is an expansion chamber, 26 which is a pressure release valve, and 27 which is a line.

In addition to the components of the system shown at FIG. 1, and discussed above, the pressure sensitive circuit breaker at 23 is designed to turn off power leading to the microwave energy means at 17 FIG. 1 when excessive pressure builds up within the radiator during operation. The expansion chamber at 25 is designed to allow space for the liquid coolant within the radiator to expand when heated. The pressure release valve at 26 is designed to allow excess pressure to escape the system when the liquid coolant over expands within the system due to heating. The line at 27 indicates the un-expanded level of the liquid coolant within the system.

It will be understood that the pressure sensitive circuit breaker will be set to turn off the power circuit at FIG. 2 at a pressure which is lower than the pressure at which the pressure release valve at 26 is set to release pressure from the system.

The microwave thermal heat pump defroster system of the present invention will act to defrost the outside coil of an electric heat pump while the heat pump is operating in the heating mode. In other words, the flow of refrigerant will not change. The inside coil of the heat pump will continue to function as a condenser, and the outside coil will continue to function as an evaporator.

When it is determined that the outside coil of the heat pump requires defrosting, switching devices (explained later herein) will act to energize the microwave energy means, 17 FIG. 1, which in turn will commence to generate microwave energy. The microwave energy will be radiated into the microwave energy chamber, 6 FIG. 1, which is designed to receive and contain microwave energy much in the same manner as the cooking chamber of a microwave oven. Inside the microwave energy chamber, the microwave energy will be absorbed into a liquid coolant such as antifreeze, which is contained within the non-metallic liquid container shown at 9 FIG. 1. Consequently, heat will be created within the body of liquid coolant much in the same manner that heat is created within a container of water inside the cooking chamber of a microwave oven. The heat will then rise upwards by means of convection through the system of vertical pipes, 15 FIG. 1, which form the circulating system of a radiator. The heat will be absorbed into ambient air, which is caused to flow over and through the external surfaces of the radiator by means of the fan at 7 FIG. 1, before flowing over and through the external surfaces of the outside coil of the heat pump. As the ambient air containing the absorbed heat flows over and through the external surfaces of the outside coil of the heat pump, the heat will be absorbed into the molecules of frost, and/or ice accumulated thereon where it will act to defrost the coil, and finally, because the coil is functioning as an evaporator, will be absorbed into the heat pump system in the same manner that heat from ambient air is absorbed.

It will be understood that the microwave energy means shown at 17 FIG. 1 should be protected from excessive moisture within some kind of protective shield such as that shown at 18 FIG. 1. As a matter of fact, if desired, the microwave energy means could be disposed within the inside compartment of the heat pump as indicated by the dotted lines at 19 FIG. 1, in which case a wave guide, 20 FIG. 1, would be used to transmit the microwave energy to the microwave energy chamber at 6 FIG. 1.

Turning now to FIG. 2, there is shown a schematic diagram of a system designed to control the operation of the microwave energy means shown at 17 FIG. 1. At 22 there is shown a defrost demand switch, at 16 a float operated contact switch, also shown in the drawings at FIG. 1, FIG. 3, and FIG. 4, at 23, a pressure sensitive circuit breaker, also shown in the drawings at FIG. 3, and FIG. 4.

The defrost demand switch shown at 22 is in reality the contact switch of a device already in use in electric heat pumps of the prior art and will be explained in detail later herein. In an electric heat pump utilizing the present invention, the defrost demand switch is disposed to open and close a segment of the power circuit leading to the microwave energy means shown at 17 FIG. 1. Also, both the float operated contact switch shown at 16, and the pressure sensitive circuit breaker at 23, are disposed to open and close a segment of the power circuit leading to the microwave energy means.

When the device at 22 is turned on, indicating that the outside coil of the heat pump requires defrosting, the switch at 22 will close and power will be allowed to pass and flow to the float operated contact switch 16 FIG. 1. When the float of contact switch 16 determines that sufficient liquid is within the non-metallic liquid container at 9 FIG. 1 to absorb the microwave energy, the switch at 16 will close and power will be allowed to pass and flow to the pressure sensitive circuit breaker at 23. If the pressure sensitive circuit breaker 23 indicates that pressure within the radiator is normal, the switch at 23 will be closed causing power to flow to the microwave energy means, 17 FIG. 1 and the defrost cycle will begin. When the temperature within the radiator reaches a predetermined setting, the thermal sensing switch shown at 21, FIG. 1, and FIG. 4. will operate to set the fan motor at 7 FIG. 1 to a slow speed until the defrost cycle is over and the temperature of the liquid coolant within the radiator cools to a temperature which is below the predetermined setting.

When the defrost cycle is finished and power is removed from the microwave energy means, 17 FIG. 1, the heat pump will continue to operate in the heating mode until the system is turned off, or changed to the air conditioning mode.

It should be noted that microwave energy released into the microwave energy chamber shown at 6 FIG. 1, could damage the magnetron tube, or other microwave energy generating device when there is an insufficient amount of liquid within the non-metallic liquid container shown at 9 FIG. 1. to absorb such microwave energy. Therefore, it is essential that some kind of liquid detecting contact switch such as that shown at 16 FIG. 1, be provided to assure that the system is not energized when no liquid exist within the container to absorb the microwave energy.

As stated earlier herein, the device at 22 FIG. 2 is not a part of the present invention. It is in fact a system already in use to determine when an electric heat pump requires defrosting, and is thus used to activate and de-activate the reversing valve in heat pumps of the prior art in order to start, and stop the defrost cycle. When incorporated with the present invention, such systems are not employed to activate and de-activate the reversing valve of the heat pump, but instead are used to open and close a segment of the power circuit shown at FIG. 2. Some of these devices are simple timers which act to defrost the outside coil of an electric heat pump of the prior art at timed intervals whither the system needs defrosting or not. Other systems use a variety of sensors designed to defrost the coil only when certain temperature and pressure requirements are met.

It will be understood that particular care should be taken in the selection of the microwave energy means recommended in the foregoing. Although other devices are available to generate microwave energy, the magnetron tube appears to be the device most often used to create heat in apparatus such as microwave ovens. As stated earlier, heat is actually created by microwave energy when it is absorbed into a molecular substance such as water. Obviously, the size and power capacity of the microwave energy generating device to be used in the implementation of the present invention will depend on the size and capacity of the non-metallic liquid container disposed within the microwave energy chamber, the size of the outside coil of the heat pump, and the amount of frost and/or ice allowed to accumulate thereon before the defrost cycle is initiated.

In reference to the wave guide indicated by the dotted lines at 20 FIG. 1, which will be required only if alternate position 19 is used for placement of the microwave energy means, it will be understood that the size and shape of the tube or channel used to form the wave guide will depend upon the frequency of the microwave energy produced by the magnetron tube, or other microwave energy generating device employed. However, the construction of such device is simple and well known, and should not create a significant problem in the design and fabrication of a production model of the present invention.

DESCRIPTION OF AN ALTERNATE VERSION

In an alternate version of the present invention, the microwave system would act as a frost inhibitor only, and would serve to prolong the time between regular defrost cycles in heat pumps utilizing the reverse flow system. Defrosting would be accomplished in the same manner as in the prior art. The device shown at 22, FIG. 2 would be disposed to reverse the flow of refrigerant inside the heat pump system when defrosting is required, causing the inside coil of the heat pump to exchange functions with the outside coil. However, by using the present invention to inhibit the build up of frost on the external surfaces of the outside coil of the heat pump, the system should rarely require defrosting.

Turning now to FIG. 3, there is shown a schematic diagram of a system designed to control the operation of the microwave energy means shown at 17 FIG. 1 when only the alternate version of the present invention is used. At 24, there is shown an electric timer switch, at 16, a float operated contact switch, also shown in the drawings at FIG. 1, FIG. 2, and FIG. 4, and at 23, a pressure sensitive circuit breaker, also shown in the drawings at FIG. 2 and FIG. 4. Each of the above devices serve to open and close a segment of the power circuit leading to the microwave energy means at 17 FIG. 1.

When the electric timer reaches a pre-determined time setting, the switch at 24 will close and power will be allowed to pass and flow to the float operated contact switch 16 FIG. 1. When the float at contact switch 16 determines that sufficient liquid is within the non-metallic liquid container shown at 9 FIG. 1 to absorb the microwave energy, the switch at 16 will close and power will be allowed to pass and flow to the pressure sensitive circuit breaker at 23. If the pressure sensitive circuit breaker 23 indicates that pressure within the radiator is normal, the switch at 23 will be closed causing power to flow to the microwave energy means, 17 FIG. 1, and the system will commence to operate much in the same manner as in the regular version of the present invention. The system will operate until the electric timer turns off the power circuit at timer switch 24, and will commence to operate again for a pre-determined amount of time according to the setting of the electric timer.

In this version of the present invention, power leading to the power circuit shown at FIG. 3 should originate at a source that is energized only when the heat pump is operating in the heating mode.

Many changes and modifications could be made to the above. For example, in addition to, or in place of the electric timer, sensing devices could be used to set the power level of the microwave energy means shown at 17 FIG. 1, in a manner that would cause the microwave system to function at a progressively higher power setting as the temperature of the outside coil falls.

Although the disclosed embodiment of the present invention finds utility in a magnetron tube, or other microwave energy generating device for the purpose of defrosting, and/or inhibiting the accumulation of frost on the external surfaces of the outside coil of an electric heat pump, it should be understood that the foregoing relates only to a disclosed embodiment, and numerous changes and modifications may be made therein without departing from the spirit and scope of the present invention as defined in the following claims.

I claim:

1. A heat pump defroster system for the application of heat to the external surfaces of the outside coil of an electric heat pump, comprising:

a microwave energy means for generating microwave energy to defrost said outside coil of said heat pump; and a microwave energy chamber means for receiving said microwave energy, and for preventing said microwave energy from escaping into the atmosphere, and a non-metallic liquid container means to contain a liquid coolant such as antifreeze, which said liquid coolant will be heated by microwave energy within said liquid container, and a system of vertical pipes extending upwards from said non-metallic liquid container to form the circulating system of a radiator, and an expansion chamber means connected to the upper end of said system of vertical pipes to accommodate the expansion of said liquid coolant due to heating.

2. The heat pump defroster system of claim 1, further comprising a float operated contact switch for deactivating said microwave energy means when there is less than a predetermined amount of liquid coolant within said non-metallic liquid container means.

3. The heat pump defroster system of claim 2, wherein said predetermined amount is an amount of liquid coolant within said liquid container means to absorb said microwave energy.

4. The heat pump defroster system of claim 1, wherein said microwave energy means is activated when more than a predetermined amount of liquid coolant is present within said liquid container means.

5. The heat pump defroster system of claim 1, further comprising a pressure sensitive circuit breaker for deactivating said microwave energy means when them is an excessive amount of pressure within said expansion chamber means.

6. The heat pump defroster system of claim 1, further comprising a pressure release valve disposed to release excessive pressure from said expansion chamber means.

7. The heat pump defroster system of claim 1, wherein said liquid container means is enclosed within said microwave energy chamber means.

8. The heat pump defroster system of claim 1, wherein said external surfaces of said outside coil of said heat pump is substantially exposed to heat created by said microwave energy from said microwave energy means.

9. The heat pump defroster system of claim 1, wherein said microwave energy means is housed in a safe environment, away from excessive moisture.

10. The heat pump defroster system of claim 1, wherein said microwave energy means is activated at timed intervals in order to inhibit accumulation of frost on said outside coil of said heat pump.

11. The heat pump defroster system of claim 10, further comprising control means for varying said time intervals and power levels of operation of said heat pump defroster system.

12. The heat pump defroster system of claim 1, wherein microwave energy generated by said microwave energy means, and applied to the external surfaces of said non-metallic liquid container means will create heat therein, and act to defrost said outside coil of said heat pump, or act to inhibit the accumulation of frost on the external surfaces of said outside coil of said heat pump; and wherein said heat will be absorbed into said outside coil of said heat pump and used to improve the efficiency of said heat pump.

13. The heat pump defroster system of claim 1 comprising a thermal sensing switch to set the speed of the fan motor in the outside compartment of said heat pump at a slow speed during the defrost cycle of said heat pump.

14. A method for defrosting the outside coil of an electric heat pump, comprising the steps of:

providing a microwave energy means housed in a safe environment away from excessive moisture; and a microwave energy chamber means wherein a non-metallic liquid container means is housed, wherein said liquid container means contains a quantity of liquid coolant such as antifreeze, wherein microwave energy generated by said microwave energy means is radiated into said microwave energy chamber means in a manner that will create heat within said liquid coolant in order to apply said heat to the external surfaces of said outside coil of said heat pump while said heat pump is operating in the heating mode so that said outside coil of said heat pump is defrosted with heat generated by said microwave energy without the need to reverse the flow of refrigerant within said heat pump, and allowing said heat to be absorbed into the heat pump system via the outside coil of said heat pump.

15. The method of claim 14, further including the step of deactivating said microwave energy means when liquid coolant within said container means is below a predetermined level.

16. The method of claim 14, further including the step of periodically energizing said microwave energy means.

* * * * *